United States Patent [19]

Anderson et al.

[11] 3,962,974

[45] June 15, 1976

[54] PRESSURE-ARMED ORDNANCE FUZE

[75] Inventors: Matthew E. Anderson; Stephen L. Redmond, both of China Lake, Calif.

[73] Assignee: The United States of America as represented by the Secretary of the Navy, Washington, D.C.

[22] Filed: Jan. 4, 1973

[21] Appl. No.: 322,804

[52] U.S. Cl. ..... 102/81; 102/7.2; 102/70 R

[51] Int. Cl.[2] ..... F42C 5/00

[58] Field of Search ..... 102/70, 81, 81.2, 7.2

[56] References Cited

UNITED STATES PATENTS

| | | | |
|---|---|---|---|
| 2,926,609 | 3/1960 | Van Goey et al. | 102/81 X |
| 3,170,398 | 2/1965 | Paulson et al. | 102/6 |
| 3,362,333 | 1/1968 | Czajkowski et al. | 102/81 |
| 3,583,321 | 6/1971 | Anderson et al. | 102/81 |
| 3,646,889 | 7/1970 | Davis | 102/7.2 |
| 3,678,859 | 7/1972 | Wesson et al. | 102/81 |

*Primary Examiner*—Harold Tudor

*Attorney, Agent, or Firm*—R. S. Sciascia; G. J. Rubens

[57] ABSTRACT

An air droppable, air-tight warhead cannister containing a plurality of prearranged bomblets, each bomblet having a novel pressure-sensitive fuze capable of being committed to an "armed" position by the presence of a predetermined fluid pressure in the cannister, and advanced to a fully "armed" position when said fluid pressure is dissipated and said bomblets dispersed from their prearranged disposition within the cannister.

5 Claims, 6 Drawing Figures

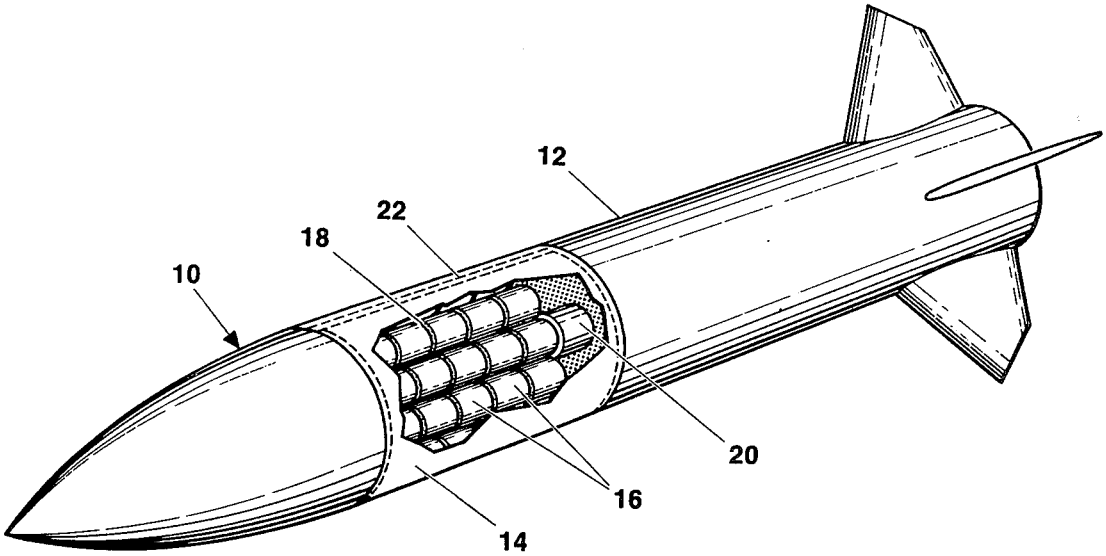
FIG. 1
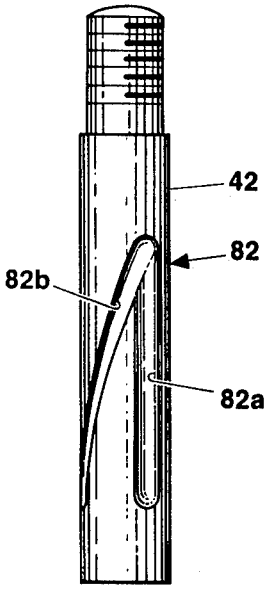
FIG. 5
FIG. 6
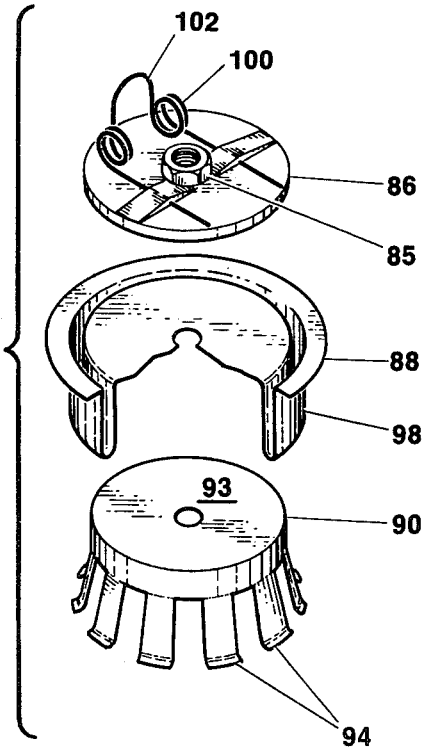

(ARMED POSITION)

(COMMIT-TO-ARM POSITION)

(SAFE POSITION)

PRESSURE-ARMED ORDNANCE FUZE

CROSS REFERENCE TO RELATED APPLICATION

This invention is an improvement on an invention entitled "Pressure Armed Explosive Apparatus" filed by Matthew E. Anderson et al on Apr. 12, 1971 under Ser. No. 140,968.

BACKGROUND OF THE INVENTION

This invention relates to ordnance devices and more particularly to fuzes that are armed by a fluid pressure instead of any spinning momentum to which the device may be subjected.

Bomblets using spin-armed fuzes have been accidentally "armed" by spillage or other means at landing fields and particularly during arrested landings on board aircraft carriers. Because of the casualties that could occur, and the hazards involved, current Navy Directives require aircraft returning from operational flights to jettison any spin-armed type ordnance prior to landing on carriers. Needless to say, such wastage is costly and is a needless drain on armament supplies.

The present fluid pressure-armed fuzes present improvements in the manner of environmentally sealing the fuze described in the above identified patent applications, provide improved reliability, and contains an interlock mechanism to prevent arming of the fuze before the bomblets are dispersed from the cannister.

SUMMARY OF THE INVENTION

The bomblets for which the novel fuze is designed are oriented in a predetermined disposition within a pressurizable delivery cannister. The novel fuze comprises a housing for a rotor which supports a detonator oriented with respect to a firing mechanism. The housing is provided with a gas inlet leading to one side of the housing sealed from the fuze mechanism by a diaphragm. The rotor is driven by a plunger through a cam slot and pin on the respective members. The rotor is initially positioned to a "commit-to-arm" position by gas pressure. The plunger is loaded by a main spring for rotating the rotor to a final "armed" position. When the delivery cannister is pressurized, the gas is admitted simultaneously to all of the fuze housings. As the pressure builds up on the diaphragm the plunger translates downward without rotating to rotate the rotor. Upon the application of a predetermined amount of pressure, the plunger travel is sufficient to be advanced to an intermediate and committed position, namely a "commit-to-arm" position, which movement compresses the main spring. As long as the pressure is being applied, the plunger and rotor remain in the " commit-to-arm" position. When the gas pressure is removed, such as by the fragmentation of the delivery cannister for the purpose of broadcasting the bomblets over the target area, the plunger is returned to its original position by the compressed main spring rotating the rotor to the "armed" position. In this position, the firing mechanism is in position to strike the detonator through impact and ignite the explosive train to the bomblet explosive.

One of the novel features of the invention is the use of an interlock spring to prevent each bomblet fuze from being advanced to the "armed" position should pressure fail for any reason while the bomblets are still assembled in the delivery cannister.

STATEMENT OF THE OBJECTS

An important purpose of the invention is to provide a pressure-active fuze that is more reliable in operation.

Another important object is to provide such a fuze which has improved sealing properties to protect the fuze mechanism from the environment.

Still another important object is to provide an interlock mechanism to prevent the fuzes from becoming fully "armed" as long as the bomblets remain in an assembled relationship within the delivery cannister.

Other objects, advantages and novel features of the invention will become apparent from the following detailed description of the invention when considered in conjunction with the accompanying drawings.

BRIEF DESCRIPTION OF THE DRAWINGS

FIG. 1 is a perspective view of a missile cannister partially cut-away to show the prearranged disposition of the bomblets.

FIG. 5 is an enlarged longitudinal view of the plunger showing the inverted V-shaped cam slot.

FIG. 6 is an exploded perspective view of the interlock spring, crown-spring and diaphragm assembly.

Figure 4:
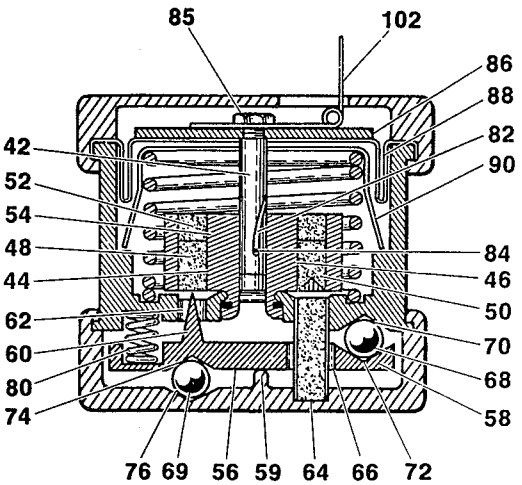
FIGS. 2, 3, and 4 are longitudinal section views of the fuze in "safe", "commit-to-arm", and "armed" positions, respectively.

Referring to the drawings where like reference numerals refer to similar parts throughout the figures, there is shown in FIG. 1 an armament 10 which may be in the form of an air droppable missile 12 having an air-tight warhead cannister section 14. A portion of the cannister is broken away to show the packaging of a plurality of bomblets 16 in a predetermined disposition end-to-end for a purpose later to be described. Each bomblet is provided with a pressure-sensitive fuze 18.

Warhead section 14 is fluid pressurized, preferably a gas such as air, through a safety arming device 20 for the purpose of activating fuzes 18 in each bomblet, after the cannister has reached a safe separation distance from the launch vehicle. Warhead section 14 is fragmented by another command signal and by means of one or more linear explosive charges 22 enables the bomblets to be released from the cannister and broadcasted over the target area. As is taught in our prior above-identified patent application, the loss of pressure occasioned by the opening of the pressurized cannister to atmosphere can be utilized to finally "arm" the fuzes for detonation upon contact with the intended targets.

The details of the preferred embodiment of pressure-sensitive contact fuze 18 are shown in FIGS. 2 through 6 inclusive. The fuze comprises preferrably a cylindrical housing 24 having a main body portion 26, closed at both ends by a cap 28 and a base 30 which can be attached by press-fitting or the like. A fluid inlet opening 32 is provided in cap 28 to admit high pressure fluid, i.e., air, into the housing from safety arming device 20 to activate the fuze in a manner to be described.

A disc-shaped rotor 34 is rotatably supported on an internal housing wall 36 by means of a bearing 38. Rotor 34 is provided with an axially drilled opening 40 slidably to receive a plunger 42. Offset longitudinal drilled passages 44 and 46 are diametrically disposed in the rotor and are adapted to house a stab detonator 48 and an explosive transfer lead 50 respectively, explosively connected together by an explosive train 52 housed in a semi-circular groove 54.

A firing mechanism 56 is housed within base 30, and comprises a sear 58, formed as a circular plate, and intermediately supported on fulcrum 59 integral with base 30. On the upper sear face, a firing pin 60 projects upwardly through a drilled opening 62 in wall 36 to be aligned with stab detonator 48 when the rotor is only in an "armed" position, as shown in FIG. 4. In the "armed" position of the rotor explosive transfer lead 50 is longitudinally aligned with an explosive output lead 64 being supported at its ends by body wall 36 and base 30 and freely projecting through aperture 66 in sear 58. Output lead initiates the bomblet explosive charge, not shown.

Figure 3:
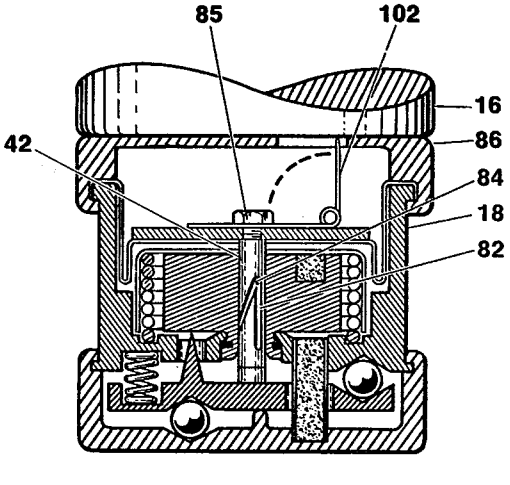
Figure 2:
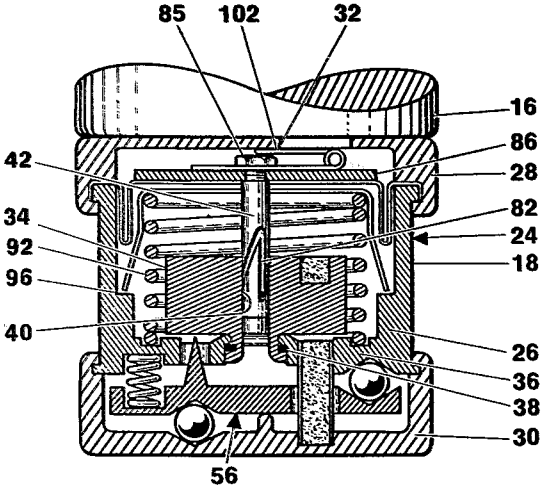

Sear plate 58 is supported in an inoperative and balanced position on fulcrum 59 by a pair of upper sear balls 68 (only one being illustrated) seated in oppositely disposed conical seats 70 and 72 in body walls 36 and sear 58, respectively, and at the other side of the sear by a single sear ball 69 seated in conical seats 74 and 76 in sear 58 and base 30, respectively. Sear 58 is maintained in the balanced and inoperative condition, as shown in FIGS. 2 to 4, by a pair of sear bias compression springs 80 disposed diametrically with respect to the pair of sear balls 68. Sear bias springs 80 are seated in suitable recesses in body wall 36 and sear 58. The firing mechanism is designed to operate upon with the intended target, at which time the inertial forces on the sear balls created by impact from any orientation causes the balls to be displaced to cam sear 58. Rotation of sear about pivot 59 causes the firing pin to puncture detonator 48 to initiate the explosive train and subsequently the explosive charge of the bomblet to which the fuze is mounted. The impulse created by target impact must be of sufficient magnitude to overcome the bias force on the sear by sear springs 80.

Movement of rotor 34 from the "safe" position in FIG. 2 to the "armed" position in FIG. 4 is accomplished by an inverted V-shaped cam slot 82 in plunger 42 in which rides a cam pin 84 fixed in rotor 34. As best shown in FIG. 5, slot leg 82a is substantially straight, whereas slot leg 82b is helical and milled deeper than leg 82a so that when pin 84 reaches the upper end of leg 82a it falls into deeper slot 82b and is committed to travel therealong to drive rotor 34, this being the "commit-to-arm" position of the fuze mechanism.

The upper end of plunger 42 and nut 85 secures together a sealing assembly including a disk 86, a diaphragm 88, and a crown spring 90, best shown in FIG. 6. A main compression or arming spring 92 is seated at its lower end in wall 36 and bears against base 93 of the crown spring. Main spring 92 serves two principal purposes, namely, it prevents the fuze from arming until the fuze is subjected to a prescribed level of air pressure, and, secondly, it advances the rotor from the "commit-to-arm" to the "armed" position when the air pressure is vented and the bomblets dispersed from delivery cannister 12.

Crown spring 90 has a plurality of resilient spaced fingers 94 extending substantially downwardly from base 93, the free ends of fingers 94 normally abutting an internal housing shoulder 96 to prevent plunger 42 from moving downward under the air pressure to actuate rotor 34.

Diaphragm 88 extends entirely across the housing cavity and clamped in position at its peripheral lip by cap 28. In this manner the diaphragm seals the fuze mechanism from the atmosphere and air pressure admitted into the body through fluid inlet 32. Thus, the diaphragm provides the necessary sealing without the prior reliance on a sliding seal. Diaphragm 88 has a folded annular portion 98 depending to a position adjacent spring fingers 94. The resiliency of fingers 94 is selected such that the initial air pressure admitted to the fuze will first depress the fingers inwardly for disengagement from shoulder 96 before the pressure builds up sufficient to commence the axial movement of sealing disk assembly 86.

A safety interlock device is provided that prevents the fuze from advancing to the "armed" position should the fluid pressure in the warhead section 14 fail for any reason when the bomblets are still packed in the delivery cannister in end-to-end disposition as shown in FIG. 1. In the preferred embodiment the interlock mechanism is in the form of a U-shaped spring 100 with its ends anchored to the top of sealing disk 86. The intermediate looped spring portion 102 is biased to extend in a normal position with respect to sealing disk 86, at which time it is adapted to project into fluid inlet opening 32. Should an adjacent bomblet still be in end-to-end position, as shown in FIGS. 2 and 3, after the high air pressure has depressed plunger 42 and advanced rotor 34 to the "commit-to-arm" position, spring leg 102 will have been released from confinement in cap 28 and freed to extend longitudinally into opening 32 (see FIG. 3). Thereafter, if air pressure in the cannister fails for any reason while the bomblets are still packed in the warhead section, spring 102 will physically prevent plunger 42 to return to the upper position and advance the rotor to the "armed" position.

In other words, safety device 100 insures that fuze 18 cannot advance from a "commit-to-arm" position to an "armed" position until the bomblets are dispersed from within the cannister.

The novel fuze eliminates the deficiencies found in applicant's previous device while retaining all of the advantages. The present fuze provides a more compact design which is always important where space and payload are critical operational considerations. By using a diaphragm in lieu of O-rings, a more positive hermetic seal is obtained which protects the internal fuze mechanism from the environment. The diaphragm is further utilized to release a fuze interlock upon the initial buildup of pressure. Premature arming is prevented by an interlock spring that senses the presence of an adjacent bomblet.

Obviously many modifications and variations of the present invention are possible in the light of the above teachings. It is therefore to be understood that within the scope of the appended claims the invention may be practiced otherwise than as specifically described.

What is claimed is:

1. A safety, arming and firing device comprising:

a housing having a fluid inlet port;

a rotor mounted within said housing and normally oriented to a "safe" position;

said rotor supporting a detonator;

a firing mechanism mounted in said housing for initiating said detonator when aligned therewith;

rectilinear driving means positioned within the housing and movable a predetermined distance in one direction with respect to the rotor in response to a predetermined external source of fluid pressure admitted through said inlet port to orient the rotor in a "commit-to-arm" position;

said driving means having means for rotating the rotor from the "commit-to-arm" position to an "armed" position where said detonator is aligned with the firing mechanism;

an arming spring energized by said fluid pressure for returning said driving means toward the original position in the absence of said fluid pressure to effect said rotor rotation;

means for locking said driving means in said "safe" position;

said locking means comprising a shoulder on the internal wall of the housing and a crown spring having laterally compressible fingers normally engaging said shoulder;

means responsive to the fluid pressure for releasing said locking means;

said releasing means being a flexible cup-shaped diaphragm extending across said housing to seal the rotor from the inlet port, said diaphragm having a portion extending laterally adjacent said fingers for disengaging the latter under fluid pressure.

2. A safety, arming and firing device comprising:

a housing having a fluid inlet port;

a rotor mounted within said housing and normally oriented to a "safe" position;

said rotor supporting a detonator;

a firing mechanism mounted in said housing for initiating said detonator when aligned therewith;

rectilinear driving means positioned within the housing and movable a predetermined distance in one direction with respect to the rotor in response to a predetermined external source of fluid pressure admitted through said inlet port to orient the rotor in a "commit-to-arm" position;

said driving means having means for rotating the rotor from the "commit-to-arm" position to an "armed" position where said detonator is aligned with the firing mechanism;

an arming spring energized by said fluid pressure for returning said driving means toward the original position in the absence of said fluid pressure to effect said rotor rotation;

means for locking said driving means in said "safe" position;

means responsive to the fluid pressure for releasing said locking means;

interlock means provided between the rectilinear driving means and an adjacent device capable of sensing the presence of said adjacent device and preventing said rotor from returning to its original position and arming the fuze.

3. The firing device of claim 2 wherein said interlock means is a leaf spring capable of projecting through said inlet port to engage said adjacent device after the fluid pressure has committed said rotor to an armed position.

4. The firing device of claim 3 wherein visible means are provided on the end of the spring for indicating the position of the fuze.

5. A safety, arming and firing device comprising:

a housing having a cap at one end provided with a gas inlet port;

a flexible diaphragm extending across said housing and secured to the housing by said cap forming a gas chamber on one side of the diaphragm;

a rotor member mounted within said housing on the opposite side of the diaphragm;

said rotor member having a detonator and an explosive train;

a firing mechanism for initiating said detonator;

a plunger member slidably mounted axially in said rotor member, one of said members having a V-shaped cam slot and the other member having a cam pin engaging said slot for rotating the rotor to an "armed" position where said detonator is aligned with said firing mechanism;

spring means to lock said plunger member in a "safe" position and capable of being compressed by said gas pressure to free said plunger;

said plunger being movable in one direction in response to gas pressure admitted through said inlet port to orient said rotor in an intermediate "commit-to-arm" position;

an arming spring acting on said plunger in the absence of gas pressure to return said plunger back toward its original position thereby rotating said rotor to the "arm" position; and, an interlock spring mounted within said housing and movable with said plunger for projecting through said inlet to sense the presence of an adjacent device and to restrain said plunger from returning to its original position and rotating the rotor to the "arm" position when said adjacent device is present.

* * * * *